US005186267A

United States Patent [19]

White

[11] Patent Number: 5,186,267

[45] Date of Patent: Feb. 16, 1993

[54] JOURNAL BEARING TYPE ROCK BIT

[75] Inventor: Kenneth M. White, Calgary, Canada

[73] Assignee: Western Rock Bit Company Limited, Calgary, Canada

[21] Appl. No.: 651,567

[22] Filed: Feb. 6, 1991

[30] Foreign Application Priority Data

Feb. 14, 1990 [CA] Canada ..... 2009987

[51] Int. Cl.[5] ..... E21B 10/22

[52] U.S. Cl. ..... 175/371

[58] Field of Search ..... 175/371, 372, 227, 228, 175/359, 364, 370; 384/92, 94, 95, 96

[56] References Cited

U.S. PATENT DOCUMENTS

| | | | |
|---|---|---|---|
| 4,597,455 | 6/1986 | Walters et al. | 175/372 |
| 4,753,303 | 6/1988 | Burr | 175/372 |
| 4,753,304 | 6/1988 | Kelly, Jr. | 175/371 |
| 4,874,047 | 10/1989 | Hixon | 175/371 |
| 4,880,068 | 11/1989 | Bronson | 384/96 X |
| 4,903,786 | 2/1990 | Welsh | 384/94 X |
| 4,934,467 | 6/1990 | Langford, Jr. | 175/371 |
| 4,955,440 | 9/1990 | Chavez | 384/94 X |
| 5,024,539 | 6/1991 | Vezirian | 384/96 X |

FOREIGN PATENT DOCUMENTS

| | | | |
|---|---|---|---|
| 1026315 | 2/1978 | Canada | 255/73 |
| 1031766 | 5/1978 | Canada | 255/78 |
| 1039266 | 9/1978 | Canada | 255/77 |
| 1064013 | 10/1979 | Canada | 255/73 |
| 1081686 | 7/1980 | Canada | 255/73 |
| 1085381 | 9/1980 | Canada | 255/77 |
| 1087164 | 10/1980 | Canada | 255/77 |
| 1094048 | 1/1981 | Canada | 255/50 |
| 1132974 | 10/1982 | Canada | 255/77 |
| 1148137 | 6/1983 | Canada | 255/73 |
| 1154751 | 10/1983 | Canada | 255/73 |
| 1202297 | 3/1986 | Canada | 255/78 |
| 1227789 | 10/1987 | Canada | 255/74 |

*Primary Examiner*—Ramon S. Britts
*Assistant Examiner*—Frank S. Tsay
*Attorney, Agent, or Firm*—Jones, Tullar & Cooper

[57] ABSTRACT

An improved journal bearing for rotary cone type mining or oilfield rock bits is disclosed. Such rock bits typically have several cutters each rotatably mounted on a cantilevered bearing pin. The cutter and respective bearing have complementary journal bearing surfaces. A retainer is provided at one end at the bearing surfaces for keeping the cutter on the bearing pin and a seal is provided at the opposite end. In addition to the usual axial thrust surface located towards the radially inner end of the bearing pin, one or more secondary axial thrust surfaces are provided in one embodiment of the invention. Alternatively, at least one series of grooves or other axial lubricant flow restrictor is provided at the complementary bearing surfaces. The invention greatly improves the load carrying capacity of the bearing.

11 Claims, 3 Drawing Sheets

JOURNAL BEARING TYPE ROCK BIT

FIELD OF THE INVENTION

This invention relates to an improved journal bearing structure for rotary cone type mining or oilfield rock bits.

BACKGROUND OF THE INVENTION

The initial appearance of the journal bearing rock bit for drilling applications in 1963 revolutionized rock bit consumption and drilling costs. This type of bearing made it possible for the bearing structure to have a service life that exceeded the life of the cutting structure in many types of drill bits.

Rock bits with journal bearings consist of the following common component parts. Firstly, there are three head sections that are generally welded to form a unitized configuration. Each of these head sections has a cantilevered lower portion forming a mounting for the conical cutter, this mounting being the journal bearing pin. Associated areas of the bit construction consist of three independent lubrication systems, one for each bearing, and nozzles to direct fluid flow from the central bore of the rock bit body to the formation to remove drill cuttings.

Journal bearing pins of prior art rotary bits have five major characteristic features. These as viewed from the longitudinal centerline of the drill bit towards the outside diameter consist of a nose pin, an axial thrust surface, a locking system, a main journal bearing, and a seal surface. This general layout has historically proven to be the most satisfactory configuration.

Each of the five major areas serves a specific purpose and when operating in unison provides a technologically sound bearing structure. The nose pin adds marginally to the overall load capacity of the assembly but is primarily provided to add axial stability to reduce cone wobble during drilling. In certain cases, the axial thrust capacity of the bearing is increased by adding a thrust surface to the end of the nose pin. The main axial thrust surface acts as a transition surface between the nose pin and the locking system. This thrust surface is required to resist any outward forces of the cone on the bearing assembly. Extremely high pressures are encountered here and special hardfacing or metallurgy of the bearing assembly is required in this area.

The locking system to retain the cone on the head section generally consists of an annular row of ball bearings. The ball race in the head section is positioned to co-act with a corresponding race in the cone such that when the balls are installed the cone is prevented from moving axially inward on the bearing pin. The main axial thrust face prevents outward movement.

The main journal bearing surface is the predominant area of the bearing structure. This area resists the total downward bit load and is completely dependent on the lubrication system provided in the drill bit. Numerous ways have been used to resist the forces that this bearing surface is required to operate under. Early bearings had a recess machined in the bearing pin and this recess was filled with a tungsten carbide hardfacing. This operated against a carburized and hardened journal surface in the cone. A solid lubricant of copper or silver was inlaid in the cone journal to resist seizure or galling during working operation. Later bearings use metallurgical techniques such as boronizing or nitriding to generate hard bearing surfaces in this area.

The seal area is generally an extension of the main journal bearing surface and is characterized as a highly polished area such that a low friction surface is provided for the seal to run against.

SUMMARY OF THE INVENTION

It is an object of the invention to provide a rock bit having an improved journal bearing configuration such that hydrodynamic film lubrication is maintained under varying load and operating conditions. This condition is generated by providing, in a preferred embodiment, an additional axial thrust surface(s) to discourage axial leakage of lubricant from the journal bearing surfaces in areas having high lubricant pressure. A further advantage occurs due to isolation of the seal surfaces from cyclical pressure variations such that heating due to flexural stress of the seal elastomer is reduced.

In a less preferred embodiment, instead of an additional axial thrust surface, a different type of axial lubricant flow restrictor, such as a series of annular grooves, is used.

The improved journal bearing of the invention behaves more in the manner of a Sommerfeld bearing than a short bearing in terms of its load bearing capacity.

Stated broadly, the present invention provides a sealed, lubricated journal bearing rock bit having at least one cutter rotatably mounted on a cantilevered bearing pin having a radially directed centerline axis, the cutter and bearing pin having complementary journal bearing surfaces, retention means proximate one end of the complementary journal bearing surfaces for retaining the cutter on the bearing pin and a seal proximate the other end of the complementary journal bearing surfaces, a primary axial thrust surface located towards the radially inner end of the bearing pin on one side of the retention means and at least one axial lubricant flow restrictor being located at the complementary journal bearing surfaces.

Preferably two restrictors are provided, one at the seal and the other at the retention means.

Where the restrictors are formed as axial thrust surfaces, the preferred arrangement is that the inside diameter of each axial thrust surface is greater than that of every other axial thrust surface which is located nearer the forward end of the bearing pin.

DETAILED DESCRIPTION OF THE PREFERRED EMBODIMENT

Figure 1:
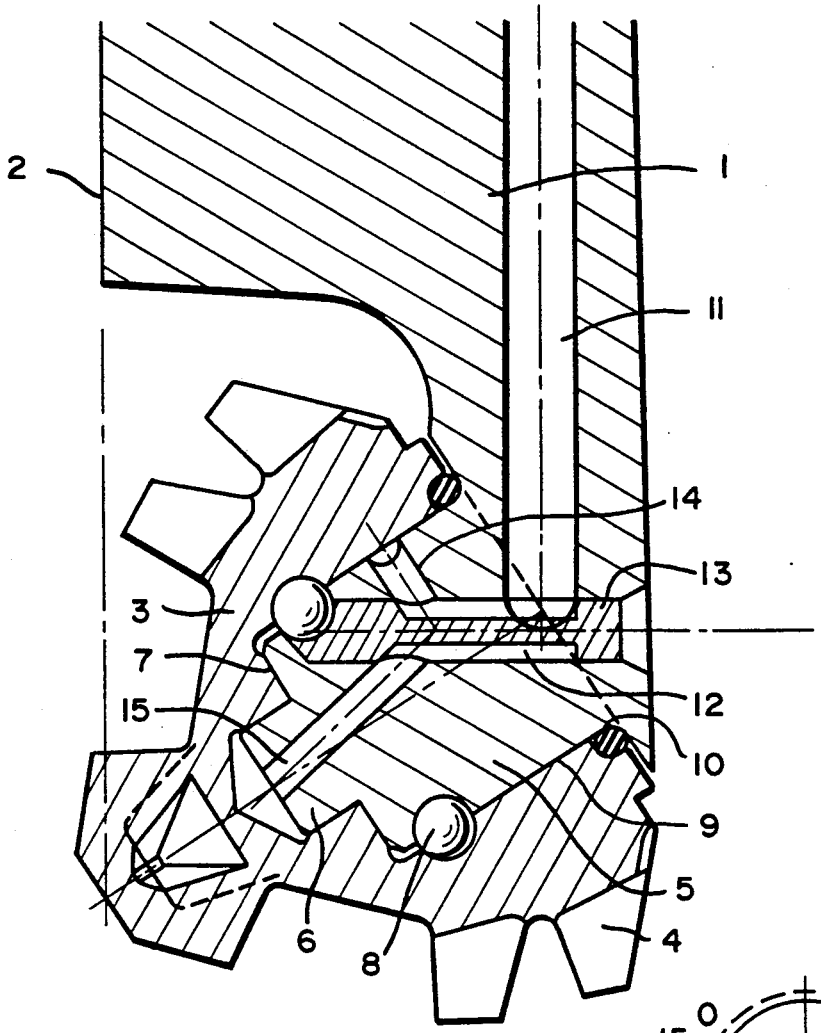
FIG. 1 (PRIOR ART)
FIG. 1 is a schematic representation of a prior art configuration of a typical journal bearing structure and partial cone section showing design details.

The head section 1 shown in FIG. 1 is one of three assembled about a longitudinal axis or centerline 2 (about which the rock bit rotates) at 120 degree intervals. Cone 3 has teeth 4 or in some cases tungsten carbide inserts (not shown) for formation engagement during working operation. Cantilevered bearing pin 5 is aligned on an axis which extends generally radially from the centerline 2 with the bearing pin having a radially inner free end proximate centerline 2 and a radially outer end remote from centerline 2. Bearing pin 5 consists of bearing surfaces generally designated as follows in order from radially innermost to radially outermost: nose pin 6; axial thrust face 7; ball lock system 8; main journal 9; seal surface 10. Complementary bearing surfaces are provided on the cutter cone 3. A lubricant reservoir (not shown) provides grease or oil through passage 11, along relief area 12 in ball retainer 13, and through holes 14 and 15 to lubricate the bearing surfaces. Various grooves and cutouts are provided in the bearing surfaces to allow the lubricant to fully wet these areas such that friction is reduced as much as possible. One critical characteristic of the previously described journal bearing structure is that the runout from the main journal surface 9 to the ballrace 8 and the seal surface 10 is at a single diameter.

Figure 2:
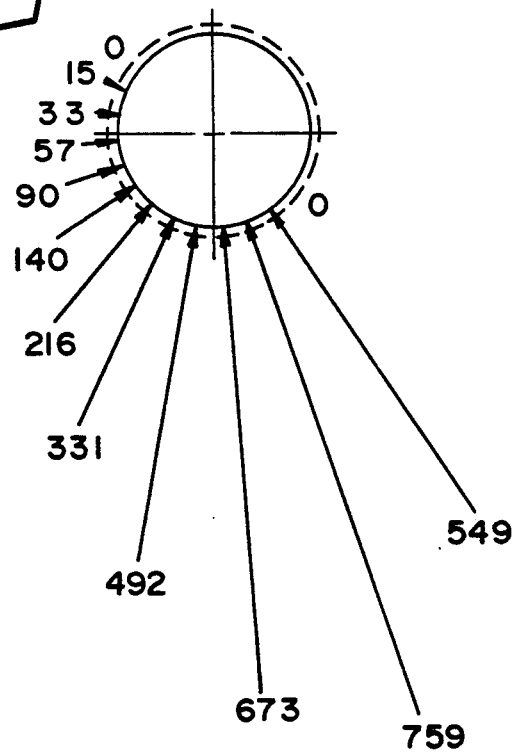
FIG. 2 is a hydrodynamic film pressure profile of a short journal bearing under operating conditions.

The pressure profile shown in FIG. 2 is for a typical journal bearing in working operation with hydrodynamic film lubrication fully established. This pressure profile is typical of FIG. 1 type bearings where the axial flow of lubricant is much greater than the circumferential flow and the bearing analysis is based on Reynolds equation for two dimensional flow. A rule of thumb is, when the ratio of the axial length of the bearing to the diameter is less than unity, the short-bearing approximation applies. The pressure profile is generated from the following equation for angles from 0 to 180 degrees.

$$P_\theta=(3*u*V/r*c^2)*\{(E\sin\theta)/(1+E\cos\theta)^3\}*((L^2/4)-z^2)$$

Figure 3:
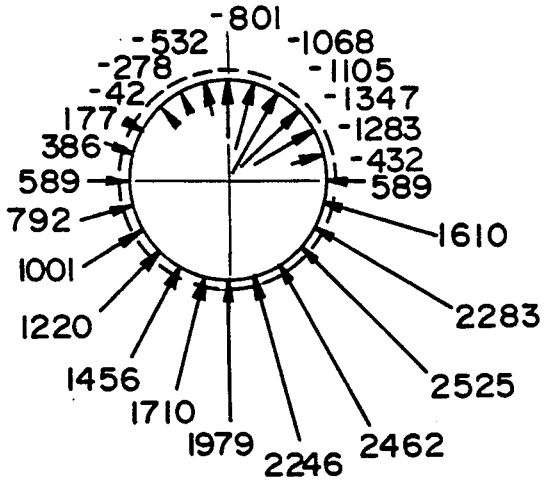
FIG. 3 is a hydrodynamic film pressure profile of a Sommerfeld bearing.

$P_\theta$=film pressure in: lbs/sq. in.
u=viscosity in: lb sec/in2
V=surface velocity $\pi$ dn/60 in: inches/sec
d=bearing diameter in: inches
L=bearing length in: inches
z=axial position of pressure profile (at L/2 P=0)
N=revolutions per minute
r=bearing radius in: inches
c=radial clearance in: inches
E=ec eccentricity ratio e lateral displacement of cone relative to journal to maintain film in: inches
$\theta$=angle in degrees from zero position for pressure plot The Sommerfeld bearing pressure in FIG. 3 depends on the axial flow of lubricant being less than the circumferential flow. This is generally applied in journal bearings where the ratio of axial length to diameter is greater than unity. The pressure profile is derived from the following equation with the same variables as FIG. 2.

$$P_\theta=(6*u*V*r/c^2)*\{(E\sin\theta)*(2+E\cos\theta)/(2+E^2)*(-1+E\cos\theta)^2\}+Po$$

Po is the pressure where=0 degrees

The load capacity per unit length of a short bearing according to FIG. 1 and FIG. 2 can be stated as follows:

$$W1 = u*V*(r/c)^2*(L/d)^2*\{E\sqrt{\pi^2(1-E^2)+16*E^2}\ /(1-E^2)^2\}$$

For a Sommerfeld bearing the equivalent equation is:

$$W1 = u*V*((r/c)^2*\{12*\pi*E/(2+E^2)\sqrt{1-E^2}\ )\}$$

Using some typical values for variables and equating like terms a relationship for relative load carrying capacity of the two types of bearings can be arrived at as follows:

Short Bearing $$W1 = u*V*\left[\frac{r}{c}\right]^2*\left[\frac{L}{d}\right]^2*\left\{\frac{E\sqrt{\pi^2(1-E^2)+16*E^2}}{(1-E^2)^2}\right\}$$

$L = 1.25''$
$d = 3''$ $$E = e/c = \frac{.001}{.002} = .5$$

where $K1 = u*V*(r/c)^2$
$W1 = .2604\ K1$

Sommerfeld Bearing $$W1 = u*V*\left[\frac{r}{c}\right]^2*\left\{\frac{12*\pi*E}{(2+E^2)\sqrt{1-E^2}\ )}\right\}$$

$r = d/2 = 1.5$
$c = .002$
$W1 = 9.6735\ K1$

This indicates an approximately 37 times greater load carrying capacity for a dimensionly equivalent Sommerfeld bearing over the short bearing theory.

Figure 4:
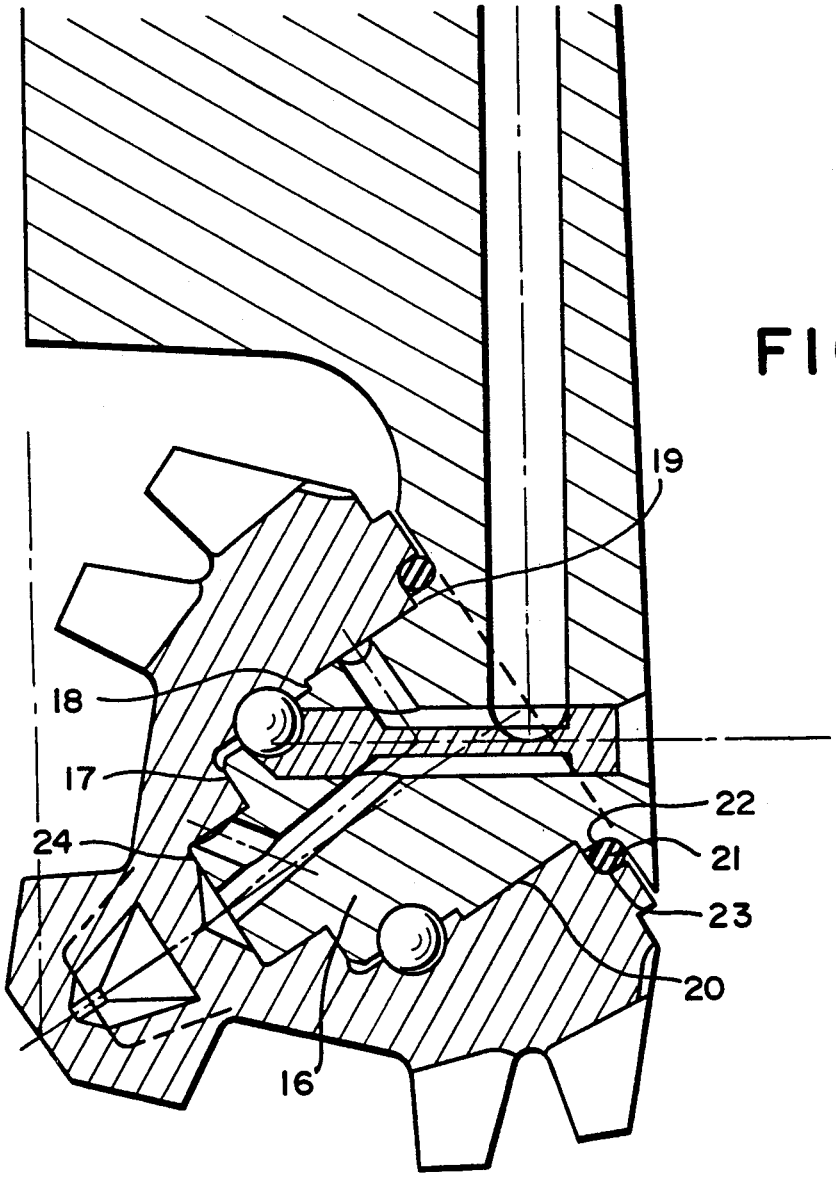
FIG. 4 is a view similar to that of FIG. 1 but illustrating an embodiment of the present invention.

The preferred journal bearing configuration is illustrated in FIG. 4. Cantilevered bearing pin 16 is of similar structure to FIG. 1 with the following exceptions. Primary axial thrust face 17 is of a smaller cross-sectional area than that of axial thrust face 7 of the prior device and secondary thrust surfaces 18 and 19 are provided for axial restriction of lubricant flow sealing of the main journal bearing surface 20. Axial thrust surface 18 can be seen to be located proximate retention balls 8 and on the radially outer side of retention balls 8 from main axial thrust surface 17. Axial thrust surface 19 is provided proximate seal 21. It can be seen that the inside diameter of thrust surface 19 is greater than that of thrust surface 18 which, in turn is greater than that of thrust surface 17. The bearing configuration shown in FIG. 4 was established for comparative purposes from FIG. 1 wherein the seal 21 of FIG. 4 is the same diameter as FIG. 1. Axial thrust surface 19 transitions the journal bearing seal surface 22 to the main journal bearing 20. The three axial thrust surface 17, 18 and 19 are diamond machined or ground to very close tolerances such that particularly surfaces 18 and 19 when mounted on the journal bearing pin form an effective restriction to axial flow of lubricant from the main journal bearing 20.

The seal 21 is of a known "O" ring type and is now effectively isolated from the main journal bearing by axial thrust surface 19. Since, as is commonly known, the seal is mounted under compression in the cone seal recess 23 and turns with the cone the seal is protected from the cyclical pressure variations as would be encountered in bearings according to FIGS. 1 and 2.

The means to prevent axial lubricant flow from the main journal bearing surfaces by providing areas of restricted clearance space can be applied to the nose pin bearing surfaces as well. Here, axial thrust face 17 becomes one restriction surface and reduced diameter at 24 becomes the second restriction.

Figure 5:
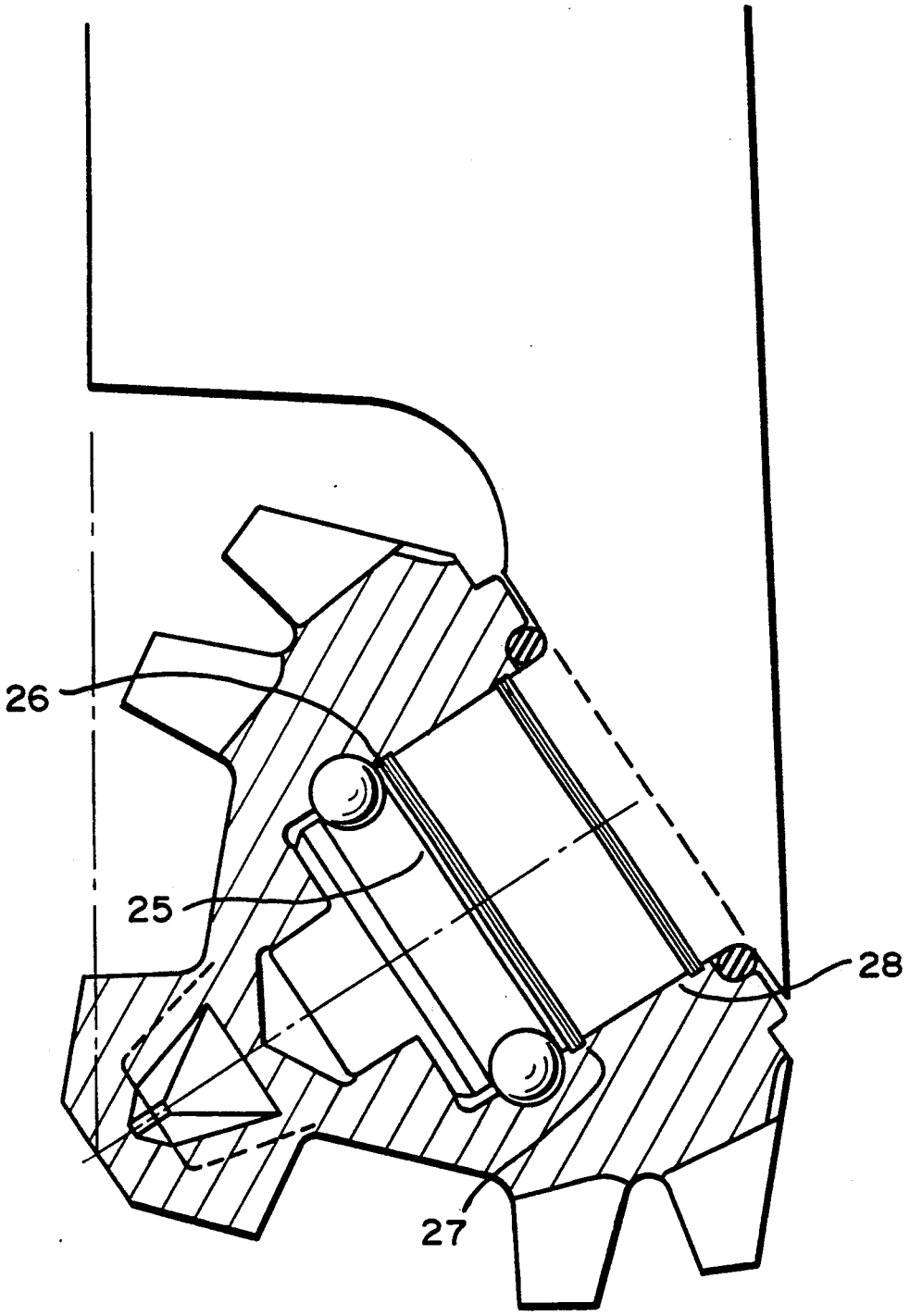
FIG. 5 is a view similar to that of FIG. 4 illustrating a labyrinth seal concept.

Various other means to reduce axial lubricant flow have been considered and are within the scope of this invention. Some of these means, for example, could consist of a series of annular grooves forming a labyrinth seal at each end of the main journal bearing as illustrated in FIG. 5. Herein a series of, in this case three at 25, shallow circumferential grooves are machined in the main journal bearing surface 20 to align with three complementary grooves 26 in the coacting cone bearing surface. One set of three grooves are provided at each end 27, 28, (i.e. at locations corresponding to secondary axial thrust surfaces 18 and 19 in the embodiment of FIG. 4) of the main journal bearing 20 effectively reducing through progressive pressure drop the high hydrodynamic pressure to ambient pressure thereby restricting axial lubricant flow. The disadvantage to this proposal is that critical axial length is removed from the main journal bearing for the seal surface. Angled thrust surfaces cause manufacturing problems. (Provision of a physical "O" ring or flat seal has been considered), but this causes loss of axial bearing length and an increase in the potential for failure.

What I claim as my invention is:

1. A sealed, lubricated journal bearing rock bit having a longitudinal axis about which the rock bit rotates, the rock bit having at least one cutter rotatably mounted on a cantilevered bearing pin aligned on an axis which extends generally radially from the longitudinal axis with the bearing pin having a radially inner free end proximate the longitudinal axis and a radially outer end remote from the longitudinal axis, the cutter and bearing pin having substantially coextensive complementary journal bearing surface extending parallel to the bearing pin axis, retention means proximate a radially inner end of the complementary journal bearing surfaces for retaining the cutter on the bearing pin and a seal proximate a radially outer end of the complementary journal bearing surfaces, a primary axial thrust surface located toward the radially inner end of the bearing pin on one side of the retention means and an axial lubricant flow restrictor located at the complementary journal bearing surfaces proximate the seal thereby reducing exposure of the seal to adverse hydrodynamic lubrication pressures during operation.

2. A rock bit according to claim 1 further comprising another axial lubricant flow restrictor located at the complementary journal bearing surfaces proximate the retention means and on the radially outer side of the retention means from the primary axial thrust surface.

3. A rock bit according to claim 1 in which the axial lubricant flow restrictor is formed of a series of annular grooves.

4. A rock bit according to claim 2 in which each axial lubricant flow restrictor is formed as a series of annular grooves.

5. A rock bit according to claim 1 in which the axial lubricant flow restrictor is formed as a secondary axial thrust surface on the bearing pin contiguous with the journal bearing surface of the bearing pin.

6. A sealed, lubricated journal bearing rock bit having a longitudinal axis about which the rock bit rotates, the rock bit having at least one cutter rotatably mounted on a cantilevered bearing pin aligned on an axis which extends generally radially from the longitudinal axis with the bearing pin having a radially inner free end proximate the longitudinal axis and a radially outer end remote from the longitudinal axis, the cutter and bearing pin having substantially coextensive complementary journal bearing surfaces extending parallel to the bearing pin axis, retention means proximate a radially inner end of the complementary journal bearing surfaces for retaining the cutter on the bearing pin and a seal proximate a radially outer end of the complementary journal bearing surfaces, a primary axial thrust surface located toward the radially inner end of the bearing pin on one side of the retention means and an axial lubricant flow restrictor formed as a series of annular grooves in the complementary journal bearing surfaces.

7. A rock bit according to claim 6 in which the axial lubricant flow restrictor is provided proximate the retention means on the radially outer side of the retention means from the primary axial thrust surface.

8. A sealed, lubricated journal bearing rock bit having a longitudinal axis about which the rock bit rotates, the rock bit having at least one cutter rotatably mounted on a cantilevered bearing pin aligned on an axis which extends generally radially from the longitudinal axis with the bearing pin having a radially inner free end proximate the longitudinal axis and a radially outer end remote from the longitudinal axis, the cutter and bearing pin having substantially co-extensive complementary journal bearing surfaces extending parallel to the bearing pin axis, retention means proximate a radially inner end of the complementary journal bearing surfaces for retaining the cutter on the bearing pin and a seal proximate a radially outer end of the complementary journal bearing surfaces, a primary axial thrust surface located toward the radially inner end of the bearing pin on one side of the retention means and two secondary axial thrust surfaces contiguous with the journal bearing surface of the bearing pin, a first one of the two secondary axial thrust surface being provided proximate the retention means and on the radially outer side of the retention means from the primary axial thrust surface and a second one of the two secondary axial thrust surfaces being provided proximate the seal thereby reducing exposure of the seal to adverse hydrodynamic lubrication pressures during operation.

9. A rock bit according to claim 8 in which the bearing pin has a nose portion at the radially innermost end, the nose portion having a secondary journal bearing surface contiguous with the primary axial thrust surface and an additional secondary axial thrust surface contiguous with the secondary journal bearing surface and located at the opposite end of such secondary journal bearing surface from the primary axial thrust surface.

10. A rock bit according to claim 8 in which the inside diameter of the second secondary axial thrust surface is greater than that of the first secondary axial thrust surface which is in turn greater than that of the primary axial thrust surface.

11. A rock bit according to claim 9 in which the inside diameter of each axial thrust surface is greater than that of every other axial thrust surface which is towards the radially inner end of the bearing pin.

* * * * *